US007267794B2

(12) United States Patent
Amick

(10) Patent No.: US 7,267,794 B2
(45) **Date of Patent: *Sep. 11, 2007**

(54) DUCTILE MEDIUM-AND HIGH-DENSITY, NON-TOXIC SHOT AND OTHER ARTICLES AND METHOD FOR PRODUCING THE SAME

(76) Inventor: Darryl D. Amick, 3227 Countryman Cir., NW., Albany, OR (US) 97321

( * ) Notice: Subject to any disclaimer, the term of this patent is extended or adjusted under 35 U.S.C. 154(b) by 352 days.

This patent is subject to a terminal disclaimer.

(21) Appl. No.: 10/857,044

(22) Filed: May 28, 2004

(65) Prior Publication Data

US 2007/0119523 A1 May 31, 2007

Related U.S. Application Data

(63) Continuation-in-part of application No. 10/358,121, filed on Feb. 3, 2003, now Pat. No. 6,890,480, which is a continuation of application No. 09/923,927, filed on Aug. 6, 2001, now Pat. No. 6,527,880, which is a continuation-in-part of application No. 09/148,722, filed on Sep. 4, 1998, now Pat. No. 6,270,549.

(60) Provisional application No. 60/474,503, filed on May 29, 2003.

(51) Int. Cl.
*C22C 38/08* (2006.01)
*C22C 38/12* (2006.01)
*F42B 30/00* (2006.01)

(52) U.S. Cl. ..... 420/94; 420/122; 148/540; 148/442; 102/448; 102/517

(58) Field of Classification Search ..... 420/94, 420/119, 122, 581; 148/336, 546
See application file for complete search history.

(56) References Cited

U.S. PATENT DOCUMENTS

| | | | | |
|---|---|---|---|---|
| 1,346,191 | A * | 7/1920 | Fahrenwald | 42/76.01 |
| 1,847,617 | A | 3/1932 | Lowenstein et al. | |
| 1,904,859 | A * | 4/1933 | Dean | 148/102 |
| 2,119,876 | A | 6/1938 | Corson | |
| 2,183,359 | A | 3/1939 | Smithells | |
| 2,775,536 | A | 12/1956 | Fine | |
| 2,919,471 | A | 1/1960 | Hechinger | |
| 2,995,090 | A | 8/1961 | Daubenspeck | |
| 3,123,003 | A | 3/1964 | Lange, Jr. et al. | |
| 3,372,021 | A | 3/1968 | Forbes et al. | |
| 3,623,849 | A | 11/1971 | Benjamin | |
| 3,669,656 | A | 6/1972 | Murphy et al. | |
| 3,785,801 | A | 1/1974 | Benjamin | |
| 3,890,145 | A | 6/1975 | Hivert et al. | |
| 3,904,383 | A | 9/1975 | Murphy et al. | |
| 3,953,194 | A | 4/1976 | Hartline, III et al. | |
| 3,979,234 | A | 9/1976 | Northcutt, Jr. et al. | |
| 3,988,118 | A | 10/1976 | Grierson et al. | |
| 4,027,594 | A | 6/1977 | Olin et al. | |
| 4,035,115 | A | 7/1977 | Hansen | |
| 4,035,116 | A | 7/1977 | O'Brien et al. | |
| 4,138,249 | A | 2/1979 | Rosof | |
| 4,274,940 | A | 6/1981 | Plancqueel et al. | |
| 4,338,126 | A | 7/1982 | Vanderpool et al. | |
| 4,383,853 | A | 5/1983 | Zapffe | |
| 4,428,295 | A | 1/1984 | Urs | |
| 4,488,959 | A | 12/1984 | Agar | |
| 4,760,794 | A | 8/1988 | Allen | |
| 4,780,981 | A | 11/1988 | Hayward | |
| 4,784,690 | A | 11/1988 | Mullendore | |
| 4,881,465 | A | 11/1989 | Hooper | |
| 4,897,117 | A | 1/1990 | Penrice | |
| 4,911,625 | A | 3/1990 | Begg et al. | |
| 4,931,252 | A | 6/1990 | Brunisholz et al. | |

(Continued)

FOREIGN PATENT DOCUMENTS

| | | |
|---|---|---|
| CA | 521944 | 2/1956 |

(Continued)

OTHER PUBLICATIONS

Sykes, W. P., "The Iron-tungsten System," Meeting of the American Institute of Mining and Metallurgical Engineers, New York, pp. 968-1008 (Feb. 1926).

Li, C.-J., et al., "Enhanced Sintering of Tungsten-Phase Equilibria Effects on Properties," The International Journal of Powder Metallurgy & Powder Technology, vol. 20, No. 2, pp. 149-162 (Apr. 1984).

"Federal's New Tungsten Pellets," *American Hunter*, Jan. 1997, pp. 18-19, 48-50.

Carmichel, J. "Heavy Metal Showdown," *Outdoor Life*, Apr. 1997, pp. 73-78.

"Steel 3-inch Magnum Loads Our Pick for Waterfowl Hunting," *Gun Tests*, Jan. 1998, pp. 25-27.

*Primary Examiner*—Roy King
*Assistant Examiner*—Ngoclan T. Mai
(74) *Attorney, Agent, or Firm*—Kolisch Hartwell, P.C.

(57) ABSTRACT

Density-enhanced compositions that are comprised of at least iron and tungsten, and articles, including firearm projectiles, formed therefrom. The articles have a density that exceeds that of steel, and which may be less than, equal to, or greater than that of lead. In some embodiments, iron is the majority component and tungsten is a minority component, with steel optionally forming a portion of the iron-containing component. In some embodiments, the article includes at least one additional minority component, such as one or more of nickel, manganese, tin, carbon, steel, chromium, molybdenum, silicon, aluminum, zinc, copper, potassium, sulfur, vanadium, and/or titanium. In some embodiments, the article is cast or otherwise formed from molten material, and in some embodiments the article is formed via powder metallurgy. In some embodiments, the article is firearm shot, a firearm slug, or a bullet.

20 Claims, 5 Drawing Sheets

U.S. PATENT DOCUMENTS

| | | | |
|---|---|---|---|
| 4,940,404 | A | 7/1990 | Ammon et al. |
| 4,949,644 | A | 8/1990 | Brown |
| 4,949,645 | A | 8/1990 | Hayward et al. |
| 4,958,572 | A | 9/1990 | Martel |
| 4,960,563 | A | 10/1990 | Nicolas |
| 4,961,383 | A | 10/1990 | Fishman et al. |
| 4,990,195 | A | 2/1991 | Spencer et al. |
| 5,049,184 | A | 9/1991 | Harner et al. |
| 5,069,869 | A | 12/1991 | Nicolas et al. |
| 5,088,415 | A | 2/1992 | Huffman |
| 5,127,332 | A | 7/1992 | Corzine et al. |
| 5,175,391 | A | 12/1992 | Walters et al. |
| 5,237,930 | A | 8/1993 | Bélanger et al. |
| 5,264,022 | A | 11/1993 | Haygarth et al. |
| 5,279,787 | A | 1/1994 | Oltrogge |
| 5,399,187 | A | 3/1995 | Mravic et al. |
| 5,527,376 | A | 6/1996 | Amick et al. |
| 5,535,679 | A | 7/1996 | Craddock |
| 5,713,981 | A | 2/1998 | Amick |
| 5,719,352 | A | 2/1998 | Griffin |
| 5,740,516 | A | 4/1998 | Jiranek, II et al. |
| 5,760,331 | A | 6/1998 | Lowden et al. |
| 5,786,416 | A | 7/1998 | Gardner et al. |
| 5,814,759 | A | 9/1998 | Mravic et al. |
| 5,820,707 | A | 10/1998 | Amick et al. |
| 5,831,188 | A | 11/1998 | Amick et al. |
| 5,847,313 | A | 12/1998 | Beal |
| 5,868,879 | A | 2/1999 | Amick et al. |
| 5,877,437 | A | 3/1999 | Oltrogge |
| 5,894,644 | A | 4/1999 | Mravic |
| 5,905,936 | A | 5/1999 | Fenwick et al. |
| 5,912,399 | A | 6/1999 | Yu et al. |
| 5,913,256 | A | 6/1999 | Lowden et al. |
| 5,917,143 | A | 6/1999 | Stone |
| 5,922,978 | A | 7/1999 | Carroll |
| 5,950,064 | A | 9/1999 | Robinson et al. |
| 5,963,776 | A | 10/1999 | Lowden et al. |
| 6,090,178 | A | 7/2000 | Benini |
| 6,112,669 | A | 9/2000 | Mravic et al. |
| 6,158,351 | A | 12/2000 | Mravic et al. |
| 6,258,316 | B1 | 7/2001 | Buenemann, Jr. et al. |
| 6,270,549 | B1 | 8/2001 | Amick |
| 6,371,029 | B1 | 4/2002 | Beal |
| 6,447,715 | B1 | 9/2002 | Amick |
| 6,457,417 | B1 | 10/2002 | Beal |
| 6,527,880 | B2 | 3/2003 | Amick |
| 6,551,376 | B1 | 4/2003 | Beal |
| 6,581,523 | B2 | 6/2003 | Beal |
| 6,591,730 | B2 | 7/2003 | Beal |
| 2002/0026967 | A1 | 3/2002 | Buenemann, Jr. et al. |
| 2003/0027005 | A1 | 2/2003 | Elliott |
| 2003/0161751 | A1 | 8/2003 | Elliott |
| 2003/0164063 | A1 | 9/2003 | Elliott |

FOREIGN PATENT DOCUMENTS

| | | |
|---|---|---|
| GB | 731237 | 12/1953 |
| GB | 2149067 | 6/1985 |
| JP | 52-68800 | 6/1977 |
| JP | 59-6305 | 1/1984 |
| JP | 1-142002 | 6/1989 |

* cited by examiner

Fig. 4
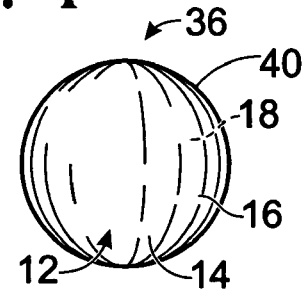
Fig. 5
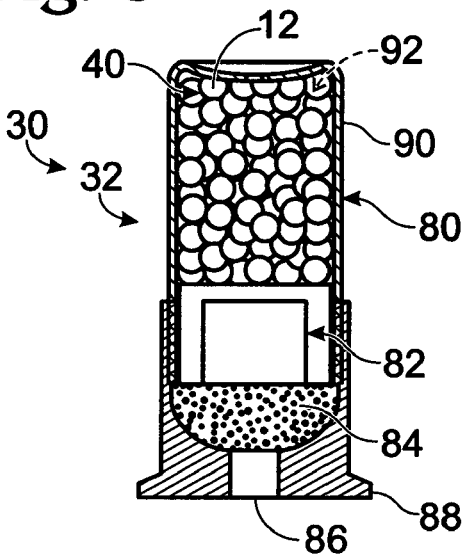
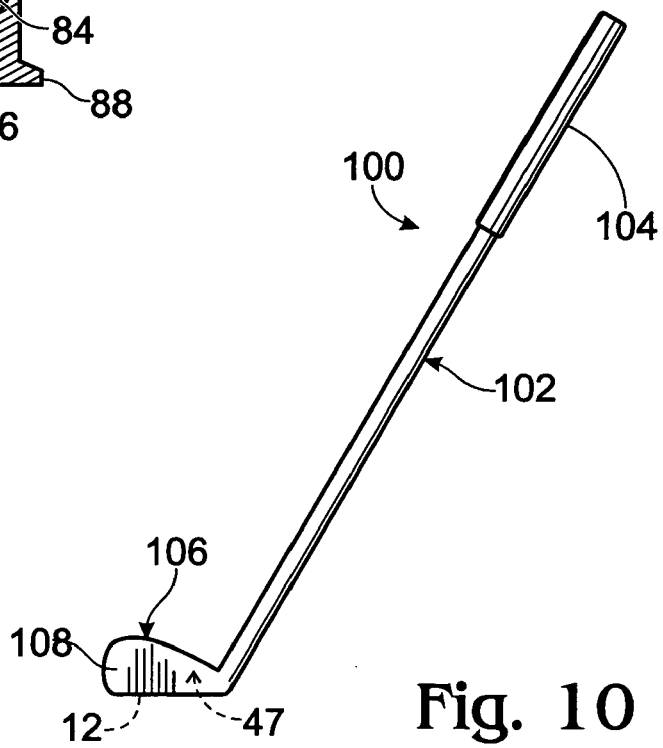
Fig. 10

DUCTILE MEDIUM-AND HIGH-DENSITY, NON-TOXIC SHOT AND OTHER ARTICLES AND METHOD FOR PRODUCING THE SAME

RELATED APPLICATIONS

This application is a continuation-in-part of and claims priority to similarly entitled U.S. patent application Ser. No. 10/358,121, which was filed on Feb. 3, 2003, issued on May 10, 2005 as U.S. Pat. No. 6,890,480, and which is a continuation of U.S. patent application Ser. No. 09/923,927, which was filed August 6, 2001, issued on Mar. 4, 2003 as U.S. Pat. No. 6,527,880, and which is a continuation-in-part of and claims priority to U.S. patent application Ser. No. 09/148,722, which was filed Sep. 4, 1998, and issued on Aug. 7, 2001 as U.S. Pat. No. 6,270,549. This application also claims priority to U.S. Provisional Patent Application Ser. No. 60/474,503, which was filed on May 29, 2003. The complete disclosures of the above-identified patent applications are hereby incorporated by reference for all purposes.

FIELD OF THE DISCLOSURE

This disclosure relates to metallic shot with improved properties for use in hunting or shooting, and to other articles traditionally made of lead alloys.

BACKGROUND OF THE DISCLOSURE

Because the use of traditional lead (Pb) shot has been outlawed for waterfowl hunting in the U.S., Canada, U.K. and other countries, much effort has been devoted to identifying a suitable substitute. To be fully satisfactory, alternative shot must possess the following attributes:

a) The material should have density similar to that of lead (Pb) shot, which is typically 11.0 g/cc. For example, it should have a density of at least approximately 8.5 g/cc.

b) The material should not cause physiological problems in wildlife which may ingest spent shot from the ground or water. Accordingly, it should be non-toxic.

c) The material should not cause significant damage to shotgun barrels. Preferably, it is softer than conventional gun barrel steel or utilized in a cartridge adapted to protect the gun barrel.

d) The projectiles should possess sufficient strength, rigidity and toughness to adequately withstand "set-back" forces associated with firing.

In addition to the above, effective lead substitutes may (but are not required to) be magnetic to easily differentiate it from illegal lead projectiles. When possible, another non-required goal is to make the material used for firearm projectiles economical to obtain and fabricate into firearm projectiles.

When selecting a material to be used instead of lead for firearm projectiles, factors that may be considered include the cost of the material, the expense of processing the material, the toxicity of the material, the density of the resulting projectile, and the strength of the resulting projectile. Examples of materials that have been used with various degrees of success to replace lead, and their approximate densities, include steel (7.9 g/cc), bismuth (9.4 g/cc), zinc (7.14 g/cc), tin (7.3 g/cc), and tungsten (19.3 g/cc). Tungsten and bismuth tend to be much more expensive the lead, although the increased expense of tungsten and its alloys needs to be balanced with the significant density of these materials. Examples of effective tungsten-based lead substitutes are disclosed in U.S. Pat. Nos. 6,447,715, 6,270,549, and 6,527,880, the complete disclosures of which are hereby incorporated by reference.

A consideration when using a lower density material, such as iron or other materials with a density of approximately 8 g/cc or less, is that projectiles formed from these materials will carry less energy at a given velocity and experience a more rapid loss of velocity (such as due to drag forces) than a lead or other higher density object having the same size and shape. In the context of firearm projectiles, lower density projectiles will tend to have less stopping power, flight trajectory and/or range than conventional lead or lead-antimony projectiles.

Steel Shot

The most widely used alternative shot is carbon steel, in spite of the fact that its density is quite low (about 7.9 g/cc) in comparison with that of lead shot (about 11.0 g/cc). Inarguable principles of physics and engineering establish that an object of lower density, when moving through a fluid (such as air), will carry less energy at any given velocity, and experience more rapid loss of velocity (due to drag forces) than an object of higher density of the same size and shape. Shotshell manufacturers have employed special powders to increase steel shot velocity, in an attempt to ameliorate its inferior ballistic properties. The "hotter" powders unfortunately create higher pressures within the gun barrel. Safety considerations have therefore prompted shotshell manufacturers to recommend that steel shells only be fired in certain types of modern, high-strength shotguns.

Bismuth Shot (U.S. Pat. No. 4,949,644 to Brown)

Bismuth alloy shot (approximately 9.4 g/cc is somewhat more dense than steel (7.9 g/cc) but not as dense as lead-antimony alloys (approximately 11-11.3 g/cc) that are conventionally used for shot and other projectiles. However, bismuth shot is considerably more expensive than lead, steel and similar shot. In addition to this shortcoming, bismuth alloys are inherently brittle and therefore tend to fracture and disintegrate upon impact (January, 1998 issue of Gun Tests). As fracture surfaces form in the shot, energy is lost which would otherwise be available to enhance penetration of the target. In this instance, it is even likely that all the increased energy gained by having higher density than steel is lost as fracture occurs. Finally, it should be noted that bismuth is non-magnetic and cannot be readily distinguished from illegal lead shot by game officers in the field.

Iron-Tungsten Shot (U.S. Pat. Nos. 5,264,022, 5,527,376 and 5,713,981 Assigned to Teledyne Industries, Inc.)

A product which began to be marketed in the USA in 1997 is a shotshell containing binary iron-tungsten alloy shot (60% Fe-40% W, by weight). Because the Fe—W is very hard (about Rockwell C50), and therefore must be ground with ceramic abrasives (alumina, silicon-carbide, diamond, etc.), particles of which become imbedded in the shot surface, this type of shot will result in severe damage in all gun barrels unless the shot is encapsulated in a special "overlapping double-wall" plastic shot cup of heavy construction. However, a theory is that it is possible for a few shot to rebound forward out of the plastic cylinder upon firing and to thereby contact the unprotected steel barrel. The consequences of forming longitudinal scratches on the barrel are that stresses produced by the expanding explosive gases will be concentrated in the regions around the scratches. A primary concern is that these stresses may be sufficiently high to cause bursting of the barrel.

Whether adequately protective or not, the special plastic shot cup (or "Wad") renders it impossible to load quantities of shot equivalent to those of traditional lead shells. For example, Fe—W shells of 2¾-inch length for 12-gauge guns contain only 1.0 ounce of shot versus 1⅛ to 1¼ ounces in corresponding lead or steel shells. The deficient pellet numbers result in correspondingly sparse pattern densities, the same problem encountered in substituting larger steel shot for traditional lead sizes, as mentioned previously. This should not preclude the use of these shot cups, or lead substitutes that require the use of these shot cups, but it is a consideration, or trade off, to be evaluated.

Finally, problems associated with manufacturability, and their adverse effects on product cost, are relatively severe. The constituent phases in Fe—W alloys cause the shot to be so hard and brittle as to be impossible to forge or swage these alloys into rods, or even to shape them compressively into spheres. Although the referenced patents claim Fe—W shot can be made by casting, the inherent brittleness and high melting temperatures of these alloys caused cracking to occur during rapid cooling. Cracking also plagued the process of compressive grinding, which was tried as a means of rounding the generally asymmetrical shot. Consequently, the shot actually being produced and marketed must be made by an expensive powder metallurgical method. Even with this approach, it is difficult to make cost effective smaller shot sizes with this method. This is due to the fact that powder processing costs increase exponentially as shot sizes decrease. Furthermore, the fragility of compaction tooling becomes a limiting factor as shot size decreases. Shot sizes #4 (0.130-inch), #5 (0.120-inch), #6 (0.110-inch) and #7½ (0.095-inch), traditionally preferred for hunting all but the very largest game birds (such as geese), are unavailable for these reasons.

Tungsten-Polymer Shot

A newer version of an older idea (U.S. Pat. No. 4,949,645 to Hayward et al.) is currently proposed for the U.S. market in 1998-1999 (January/February, 1995 issue of *Ducks Unlimited Magazine* and March, 1998 issue of *Petersen's Shotguns*). This shot material is a composite of tungsten powder and a powdered thermoplastic polymer. Mixtures of these two constituents are formed into spheres of cured composite, the polymer "glue" being the continuous phase and the tungsten powder particles the discontinuous phase. By virtue of its weak polymer-to-metal bonds, the material will reportedly not damage gun barrels. It is this very "weakness," however, which is one of the undesirable features of tungsten-polymer shot. Rigidity and strength are important material properties which affect the ability of shot to (1) penetrate the target effectively, and (2) remain spherical during launching and flight.

The penetrability factor can be easily understood by considering the behavior of a rubber bullet (used, for example, by police). The projectile does not penetrate well because its kinetic energy is absorbed and dissipated by its own deformation. Rigidity, as used here, is measured by a material property value known as elastic modulus. Because the elastic moduli of all organic polymers are far lower than those of metals, the subject composite materials are, as expected, less rigid than steel, Fe—W, et al. The second factor is important when a different type of shot distortion/deformation occurs which causes loss of sphericity, thereby degrading shot pattern density and uniformity. During firing, the shot experiences high compressive "set-back" forces. Materials which are relatively weak (i.e., low in yield strength), undergo various degrees of permanent distortion, referred to as "plastic deformation." Any loss of sphericity will result in erratic flight paths of shot and will therefore produce undesirable pattern uniformity.

Another disadvantage of tungsten-polymer shot is one of economics. Because polymers are much lower in density than common metals such as iron, a composite density equivalent to that of lead-antimony shot (11.0 g/cc) can only be attained by using high concentrations (e.g., 95%) of costly tungsten powder. This disadvantage is reduced, to some degree, when it is desired to produce shot or other projectiles having a density that is less than that of lead-antimony shot; however, even a relatively small amount of polymer, such as more than a few wt % will substantially increase the amount of expensive tungsten, or tungsten-containing, powder needed to produce even this lower density shot or other projectile.

Other Prior Art

Other proposed shot materials include significant concentrations of lead as a specified ingredient. However, rulings by the U.S. Fish and Wildlife Service have outlawed the use of any shot material containing more than 1.0% lead. This action has eliminated consideration of proposed materials described in a variety of U.S. Patents: U.S. Pat. No. 2,995,090 to Daubenspeck; U.S. Pat. No. 3,123,003 to Lange, Jr. et al.; U.S. Pat. No. 4,027,594 to Olin; U.S. Pat. No. 4,428,295 to Urs; U.S. Pat. No. 4,881,465 to Hooper; and U.S. Pat. No. 5,088,415 to Huffman et al. are examples.

Even materials which are lower in density than steel have been proposed for alternative shot. Examples are zinc (7.14 g/cc) and tin (7.3 g/cc), the latter being reported in the Sep. 4, 1997 issue of *American Metals Market*. Such materials certainly offer no improvement in ballistic properties over those of steel shot.

Objects and Advantages

The present disclosure addresses the problems associated with other alternative materials for forming firearm projectiles. Several objectives of the present disclosure, which may be achieved individually or in groups according to various aspects of the present disclosure, include:

a) to provide a material which is castable and formable and therefore able to be manufactured by conventional processes;

b) to provide a material which will produce a firearm projectile having a density of at least 8 g/cc and preferably at least 8.5 g/cc;

c) to provide a material which is fully as dense as conventional lead-antimony alloys (11.0 g/cc) or higher;

d) to provide a material which has a density and performance characteristics that exceed those available from steel shot or other projectiles;

e) to provide a material which, unlike Fe—W and high-carbon steel, is softer than gun barrel steels, thereby reducing or eliminating damage;

f) to provide a material which is non-toxic to wildlife and the environment;

g) to provide a material which, if desired, can be made magnetic for game-law purposes;

h) to provide a material which will not fracture or disintegrate upon impact;

i) to provide a material which will produce frangible projectiles;

j) to provide a material which is strong enough to withstand firing without distorting (but soft enough to minimize gun barrel damage);

k) to provide a material which, by virtue of its softness, is suitable for use with conventional plastic wads used for low-carbon steel, thereby making it possible for private parties to load and use it;

l) to provide a material which, by virtue of its ferromagnetic properties, may be readily salvaged for reuse;

m) to provide a castable material having a density in the range of 8-10.5 g/cc; and n) to provide a castable material having a density in the range of 10.5-15 g/cc.

SUMMARY OF THE DISCLOSURE

The present disclosure is directed to a density-enhanced composition and articles, such as firearm projectiles, that are produced therefrom. The composition comprises iron and tungsten. In some embodiments, iron is the majority component and tungsten is a minority component. In some embodiments, tungsten is a majority component and iron is a minority component. In some embodiments, at least a portion of the iron-containing component is steel. In some embodiments, the tungsten comprises less than 30 wt % of the composition. In some embodiments, the tungsten comprises less than 20 wt % of the composition. In some embodiments, tungsten comprises 20-75 wt % of the composition, and in some embodiments, tungsten is a minority component that comprises at least 20 wt % of the composition. In some embodiments, tungsten is the majority component and comprises at least 50 wt % of the composition. In some embodiments, iron comprises 10-75 wt % of the composition, and in some embodiments, iron is a minority component that comprises at least 10 wt % of the composition. In some embodiments, iron is the majority component and comprises at least 50 wt %, at least 55 wt %, and/or at least 65 wt % of the composition.

In some embodiments, the composition includes at least one additional minority component other than iron (or steel) and tungsten. In some embodiments the at least one additional minority component individually and/or collectively comprise less than 15-20 wt %, and optionally less than 15 wt %, further optionally less than 10 wt %, further optionally less than 5 wt %, and even further optionally less than 2 wt % of the composition. In some embodiments, the at least one additional minority component includes one or more of nickel, manganese, tin, carbon, steel, chromium, molybdenum, silicon, aluminum, zinc, copper, potassium, sulfur, vanadium, and/or titanium. In some embodiments, the composition has a nickel to iron (Ni:Fe) ratio that is greater than 1, while in others, it has a ratio that is less then 1.

In some embodiments, the projectile or other article is cast or otherwise formed from a molten quantity of the material, in some embodiments the projectile or other article is formed via powder metallurgy, and in some embodiments a core or intermediate article is formed and then coated and/or otherwise worked. In some embodiments, the projectile or other article is cast or otherwise formed and then worked by forging/swaging and/or finishing by machining and/or compressive grinding. In some embodiments, the article is firearm shot, in some embodiments, the article is a firearm slug, and in some embodiments the article is a bullet.

BRIEF DESCRIPTION OF THE DRAWINGS

FIG. 4 is a schematic side elevation view of shot constructed from a density-enhanced material according to the present disclosure.

FIG. 5 is a schematic, cross-sectional depiction of a firearm cartridge in the form of a shot shell containing shot according to the present disclosure.

FIG. 10 is a schematic side elevation view of a golf club constructed with a golf club weight constructed from a density-enhanced material according to the present disclosure.

DETAILED DESCRIPTION AND BEST MODE OF THE DISCLOSURE

Figure 1:
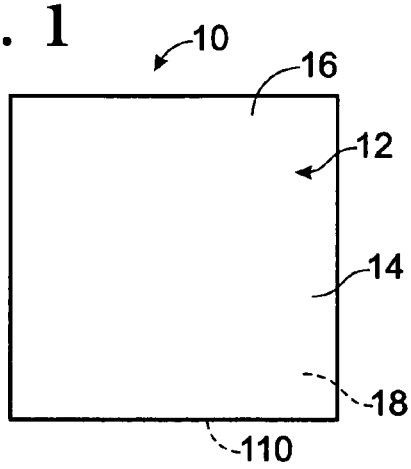
FIG. 1 is a schematic depiction of an article formed from a density-enhanced material according to the present disclosure.

An article according to the present disclosure is schematically illustrated in FIG. 1 at 10 and generically represents any shape, size, and type of article. As discussed in more detail here, article 10 may take a variety of shapes and be used for a variety of applications, including firearm projectiles and as a substitute for articles that conventionally have been formed from lead. Article 10 is at least substantially, and optionally, completely, formed from a density-enhanced composition 12 that includes iron 14 and tungsten 16.

It is within the scope of the present disclosure that either iron or tungsten may be the majority component (wt % basis) present in the composition. When iron is the majority component, the tungsten may comprise less than 40 wt % of the article. Illustrative, non-exclusive range of tungsten concentrations when iron is the majority component of the composition include less than 30 wt %, less than 20 wt %, 15-35 wt %, 20-30 wt %, 15-25 wt %, and 20-25 wt %. When tungsten is the majority component, it may comprise at least 50 wt %, at least 60 wt %, at least 70 wt %, or even at least 80 wt % of the composition. Iron will typically comprise 10-75 wt %, or more of the composition. In some embodiments, iron is a minority component that comprises at least 10 wt % of the projectile. In some embodiments, iron is the majority component and comprises at least 50 wt %, at least 55 wt %, and/or at least 65 wt % of the projectile.

The iron and tungsten present in composition 12 may be provided from any suitable source and in any suitable form. For example, composition 12 may include such components as pure (or essentially pure) iron, pure (or essentially pure) tungsten, iron-containing compounds or alloys, tungsten-containing compounds or alloys, and/or compounds or alloys that contain both iron and tungsten. For example, illustrative (non-exclusive) examples of materials that contain both iron and tungsten include ferrotungsten and an alloy of tungsten, nickel and iron.

Illustrative, and non-exclusive, examples of suitable iron-containing materials include one or more of pure iron and steel. Although it is within the scope of the disclosure that any composition(s) of steel may be used, steel that contains less than 1 wt % carbon, such as steel that includes less than 0.5 wt % carbon, or steel that includes approximately 0.2 wt % carbon or less, may be used. Generally speaking, increasing the amount of carbon tends to increase the hardness and/or brittleness of the resulting projectile. If a greater amount of hardness and/or brittleness is desired, higher carbon steel may be used and/or additional carbon may be added to the composition. If less hardness and/or brittleness is desired, low carbon steel may be used and/or less steel may be used. Other techniques for controlling hardness are discussed herein.

Illustrative, and non-exclusive examples of suitable tungsten-containing materials include ferrotungsten, tungsten carbide, alloys of tungsten, nickel and iron, tungsten obtained from reduction of wolframite without intentional removal of manganese, W—Cu—Ni, W—Co—Cr, W—Ni, alloys of tungsten and one or more of nickel, zinc, copper, iron, manganese, silver, tin, bismuth, chromium, cobalt, molybdenum and alloys formed therefrom, such as brass and bronze, and tungsten alloys disclosed and/or incorporated in the U.S. Patents referenced herein, and in U.S. Published Patent Application Serial No. 20020124759A1, the complete disclosures of which are hereby incorporated by reference for all purposes. Examples of materials that contain both iron and tungsten include ferrotungsten, including (but not limited to) ferrotungsten that is obtained from the economically important "wolframite" family of tungsten minerals having significant amounts of Mn. $FeWO_4$ is called "ferberite," $MnWO_4$ "goethite" and versions of the same mineralogical structure containing both Fe and Mn ($(Fe/MnWO_4)$ "wolframite." It is within the disclosure that ferrotungsten that is obtained form any source or process may be used, including ferrotungsten that is obtained without the intentional removal of manganese.

Density-enhanced composition 12 preferably does not contain any lead, but it is within the scope of the invention that the composition, and firearm projectiles produced therefrom, may include some lead so long as the lead component does not raise the toxicity of the projectile beyond an acceptable level, such as may be established by state, federal, or other regulatory or advisory agencies. For example, less than 1 wt % lead may be acceptable according to U.S. Fish and Wildlife Service standards. However, it is also within the scope of the disclosure that composition 12 and projectiles formed therefrom do not contain lead and/or are otherwise non-toxic.

Density-enhanced composition 12 may, but is not required to, include one or more additional minority components, as indicated in dashed lines in FIG. 1 at 18. For example, composition 12 may include one or more of manganese, nickel, carbon, tin, chromium, molybdenum, silicon, aluminum, zinc, copper, potassium, sulfur, vanadium, and/or titanium. This illustrative list is not intended to be an exclusive list, and it is within the scope of the disclosure that composition 12, and/or projectiles containing composition 12, may include still other components.

The one or more additional minority components 18 may be present in any suitable "minority" concentration, such as individually and collectively forming less than 35, 30, 25, 20, 15, or even 10 wt % of the composition. Illustrative, non-exclusive individual and/or collective ranges for the one or more minority components include 5-30 wt % of the composition, 5-15 wt %, 10-20 wt %, and 15-25 wt % of the composition. It is also within the scope of the disclosure that the one or more additional minority components 18 will individually not be present in concentrations that exceed 5 wt %, and optionally in concentrations that do not exceed 2 wt % or even 1 wt %. It is also within the scope of the disclosure that the total concentration of additional minority components 18 will not exceed 20 wt %, and optionally less than 10 wt %, 5 wt % or even 3 wt %, of density-enhanced composition 12. When present, component(s) 18 may be present in composition 12 at least partially due to the solubility of the component(s) in the ferrite phase of any ferrotungsten that is used to form composition 12.

As discussed above, the additional minority components, when present, may be present in a variety of concentrations without departing from the scope of the present disclosure. In some embodiments, it may be desirable for at least one of the one or more additional minority (non-iron and non-tungsten) components to form 5-20 wt % of the composition, with illustrative subsets of this range including 8-16 wt %, 10-15 wt %, and 11-12 wt % of the composition. Illustrative ones of these additional minority components include nickel and/or manganese. In experiments, the addition of at least approximately 10 wt % nickel to a composition containing iron as the majority component and tungsten as a minority component reduces the hardness of the projectile formed therefrom, even when high-carbon steel is used to provide a substantial portion of the iron. For example, when projectiles are formed from a molten form of composition 12, a ternary solution consisting essentially of iron, nickel and tungsten (and optionally less than approximately 1 wt % carbon) has proven effective at producing a projectile having a hardness that is less than the hardness of conventional gun barrel steels, such as a hardness within the ranges discussed below. When nickel is present as an additional minority component, composition 12 may (but is not required to) be at least partially, or even substantially or completely formed from nickel-stabilized austenite (FCC Fe—W) and/or a BCC solid solution of tungsten, nickel and iron. For example, it/they may form at least 50 wt %, at least 70 wt %, at least 80 wt %, at least 90 wt %, or more of the projectile or other article.

Although not required, it is within the scope of the present disclosure that composition 12 (and the method of forming articles therefrom) may be selected to produce articles (such as projectiles) having a hardness that is less than the hardness of conventional gun barrel steel. For example, the projectiles may have a hardness that is less than 275 Brinell, and optionally less than 270 or even less than 265 Brinell.

Composition 12 may selectively be (ferro)magnetic or not, such as depending upon the relative concentration of magnetic components present therein. For example, nickel (when present) tends to decrease the magnetism of the composition (and articles formed therefrom). Iron and certain phases of alloys and/or solid solutions that contain iron (such as binary and ternary solid solutions that include tungsten) tend to be magnetic.

Projectiles 36 formed from composition 12 may be frangible or infrangible (not frangible), depending for example upon such factors as the particular components used to form the projectile and the method by which the projectile is formed. By "frangible," it is meant that the projectile is designed to remain intact during flight but to break into pieces upon impact with a relatively hard object. Frangible projectiles may also be referred to as non-ricocheting projectiles. Although it is within the scope of the present disclosure that projectiles 36 are constructed, or designed, to break into several pieces upon impact, it is preferred that frangible projectiles 36 are at least substantially reduced to powder upon impact, and even more preferable that the frangible projectiles are completely reduced to powder upon impact. By "substantially reduced to powder" it is meant that at least 50% of the projectile (composition 12) is reduced to powder. Preferably, at least 75% of the projectile and even more preferably at least 95% of the projectile is reduced to powder upon impact. Another exemplary construction for a frangible projectile is a projectile in which the resulting particles from composition 12 forming the projectile each weigh less than 5 grains (0.324 grams). When the projectile is frangible, it may be coated, painted, or plated to reduce particle loss during handling and machining. For example, a wax, epoxy or metal coating may be used.

Composition 12 has a theoretical, or bulk, density of at least 8 g/cc. Accordingly, shot and other projectiles and articles produced from composition 12 preferably have a density that exceeds the density of at least most conventional carbon steels. The projectiles may have densities that are less than, equal to, or greater than the density of lead (11.3 g/cc) or lead-antimony alloys (approximately 10.9-11.2 g/cc) that conventionally have been used to form firearm projectiles. For example, the projectiles may have densities in the range of 8-15 g/cc, and preferably in the range of 8.5-15 g/cc. When composition 12 contains iron as the majority component, it will often have a density that is less than the density of lead, and when composition 12 contains tungsten as the majority component, it will often have a density that is greater than the density of lead. Illustrative examples of densities that are greater than the density of lead and which may be obtained in projectiles or other articles produced according to aspects of the present disclosure include densities in the range of 11.5-13 g/cc, 12-15 g/cc, 12-13 g/cc, etc.

According to an aspect of the present disclosure, composition 12 may be designed to have a density that is greater than the density of steel (8 g/cc), but less than the density of lead or lead-antimony alloys that are conventionally used to form firearm projectiles. For example, the projectile may have a density in the range of 8-11 g/cc, and preferably 8.5-11 g/cc. In such an embodiment, iron 14 will form the primary component of the composition, and tungsten 16 will form a (or the) secondary component. Discussed in terms of elemental components, density-enhanced composition 12 will contain at least 50 wt %, and optionally at least 60, 65, 70, 75, or even 80 wt % iron and less than 40 wt % tungsten, such as less than 35 wt % tungsten, less than 30 wt % tungsten, 5-29.3 wt % tungsten, 10-25 wt % tungsten, 18-22 wt % tungsten, or 15-20 wt % tungsten.

Illustrative, non-exclusive examples of compositions 12 that contain iron as the majority component, tungsten as a minority component and nickel as an additional minority component that is present in a concentration greater than 5 wt % include 15-35 wt % tungsten, 8-16 wt % nickel, balance iron; 20-30 wt % tungsten, 10-15 wt % nickel, balance iron; 20-25 wt % tungsten, 8-12 wt % nickel, balance iron; and 20-30 wt % tungsten, 11-12 wt % nickel, balance iron. Illustrative, non-exclusive examples of compositions 12 that contain tungsten as the majority component, iron as a minority component and nickel as an additional minority component include 20 wt % iron, 25 wt % nickel, balance tungsten; 10-15 wt % iron, 20-25 wt % nickel, balance tungsten; and 20-25 wt % iron, 20-30 wt % nickel, balance tungsten. Illustrative variants of the above primarily iron and primarily tungsten compositions include adding up to 5-10 wt % of one or mote additional minority components, replacing 0-100% of the iron with manganese, and/or providing at least a portion of the iron in the form of steel and thereby adding carbon to the composition.

As discussed, a consideration when producing any commercial product is the cost of the product, both in terms of raw materials and manufacturing costs. Therefore, while a higher density projectile may be desirable from a performance standpoint, it may be desirable in some applications to produce a less expensive, lower density projectile. In some applications, such as when the projectiles will be used at ranges of approximately 25-40 yards, or less, a lower density, less expensive projectile may be commercially attractive. As a more particular example, at these shorter shooting ranges, it may even be desirable for some applications, such as when shooting shot shells, to have the wider dispersion pattern that will be provided by the lower density projectiles.

When composition 12 contains iron as the majority component and less than 30 wt % tungsten, the composition (and projectiles produced therefrom) will tend to have a density that is less than 10.5 g/cc. It is within the scope of the disclosure that the density of these (and other less-than-lead-density) projectiles may be in the range of 8-10.5 g/cc, such as depending upon the composition and relative percentages of the components thereof, as well as the methodology utilized to produce the projectile. For example, projectile 36 may have a density within the above-discussed range, including a density that is between 8-10 g/cc, between 9-10 g/cc, between 8-9 g/cc, between 8.5-9.5 g/cc, etc.

A potential benefit of composition 12 containing less than 30 wt % tungsten is that the composition may be melted at a lower temperature and with less temperature-based phase changes than iron-tungsten compositions containing greater amounts of tungsten. For example, consider the iron-tungsten phase diagram shown in FIG. 2. As indicated generally at 20, the alpha (ferrite) phase has a liquidus line that is essentially constant up to a tungsten composition of approximately 29.3 wt %. In this range, the liquidus temperature is in the range of 1529-1538° C. This temperature range is fairly readily achieved without requiring special refractory materials or other more expensive melting equipment, and is comparable to the temperature required to melt most carbon steels. By way of comparison, and as indicated generally at 22, iron-tungsten compositions that contain at least 45 wt % tungsten tend to have liquidus lines of approximately 1637° C. and therefore are much more difficult (and generally more expensive) to melt.

Figure 2:
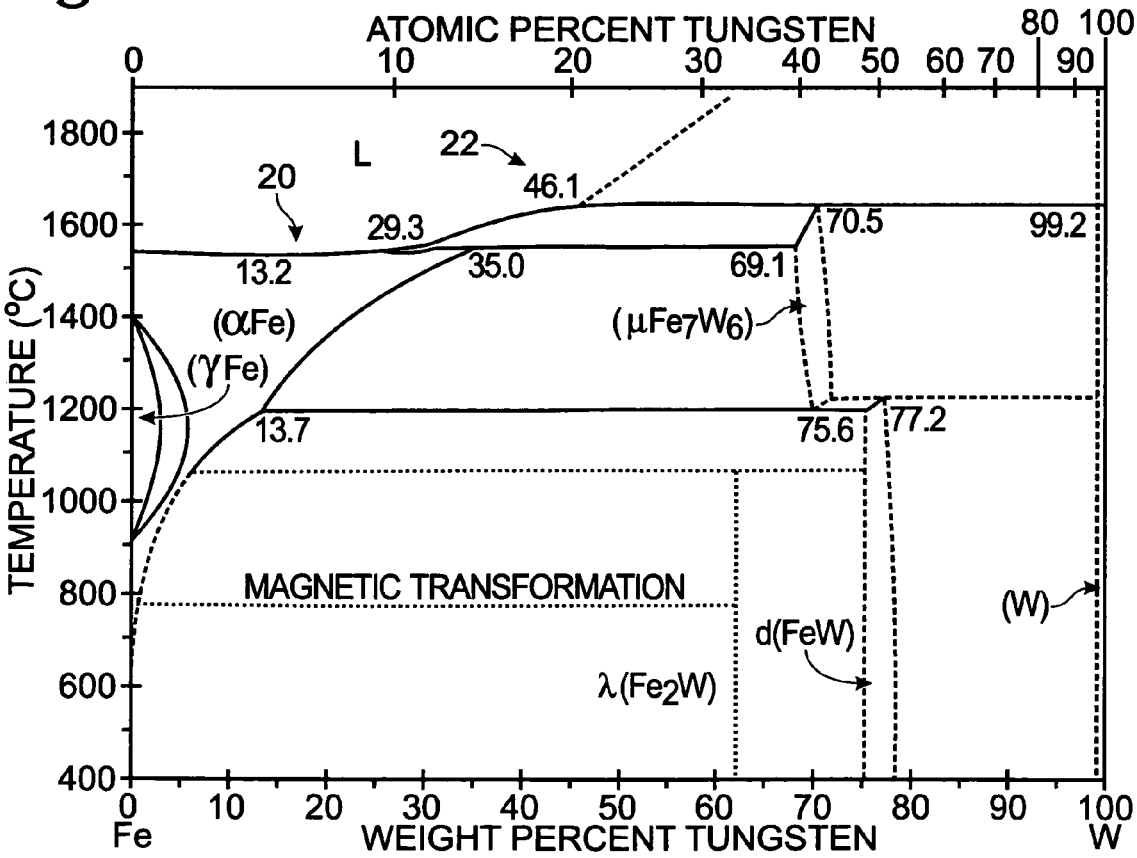
FIG. 2 is an iron-tungsten binary phase diagram.

As another potential benefit of the density-enhanced compositions of the present disclosure, the phase diagram shown in FIG. 2 demonstrates that there is an extremely small region between the solidus and liquidus lines in this lower (less than 30 wt % tungsten) range. This implies that during solidification of this composition, very little, if any, opportunity exists for alloy segregation. As demonstrated by the phase diagram at 20, the solidus line in this range lies above a single solid phase (BCC "ferrite" phase). Because there are not appreciable intermetallic compound particles in this "alpha" region, the alloy should be more ductile and softer than similar alloys that contain multiple phases and/or intermetallic compounds. Accordingly, the solidified composition will tend to have a more constant uniform composition and/or density throughout the solidified mass of material. Similarly, the solidified composition is less likely to have intermetallic compounds formed therein.

In contrast, the above-discussed higher tungsten-content compositions that are indicated generally at 22 in FIG. 2 demonstrate a much wider temperature range between the solidus and liquidus lines. For example, during cooling of a composition containing approximately 30-46 wt % tungsten, an intermetallic solid ("mu") phase precipitates from the remaining liquid and will tend to segregate to the bottom of the less dense liquid portion of the composition. Similarly, multiple-phase alloys are inherently inhomogeneous and are much more likely to contain hard, brittle intermetallic compounds. Similarly, the physical, mechanical and/or chemical properties of the different continuous (matrix) and discontinuous (particle) phases may vary and therefore produce a wider range of compositions and/or densities within a solidified mass of the composition. As another example, compositions containing greater than 46.1 wt % tungsten will tend to precipitate a solid phase of tungsten (and/or tungsten with a few weight percent iron in solid solution).

Returning to the discussion of region 20 of the Fe—W phase diagram that contains less than approximately 29.3 wt % tungsten, it can be seen that some two-phase regions (under equilibrium conditions of slow cooling) exist as the alloy is further cooled. However, quenching or other rapid cooling of the molten alloy from the alpha region should avoid most, if not all, precipitation of the second phases. Additionally or alternatively, even if some second phases are formed during (less rapid) cooling, these phases may be eliminated by annealing the cooled alloy in the alpha temperature region and then quenching.

In experiments, a molten mass of composition 12 that contained 75 wt % of 0.2 wt % carbon steel and 25 wt % of ferrotungsten (approximately 75 wt % tungsten and 25 wt % iron) was formed by heating the components to approximately 1545° C. The molten composition was poured into a quenching liquid to produce a plurality of generally irregularly shaped shot pellets. The pellets had a density of approximately 9.2 g/cc. While 9.2 g/cc is not as dense as lead (11.3 g/cc), it is still considerably denser than iron (7.86 g/cc) and steel. It should be understood that varying the relative amounts of the iron-containing (carbon steel) and tungsten-containing (ferrotungsten) components will affect the resulting density of the pellets. Similarly, the size and shape of the pellets may be varied by the technique used to form the pellets from the molten mass of composition 12.

It has been unexpectedly found that shot alloys containing 30-75% tungsten with additions of nickel, manganese and iron in certain specified proportions are castable and relatively soft, ductile, and formable. These alloys may have densities that are less than, equal to, or greater than lead, and may be formulated to have ferromagnetic properties (or not, as desired). Significant degrees of ductility and softness allow these alloys to be fabricated to finished products not only by conventional processes such as shot-drop casting and near-net-shape mold casting, but also by converting cast ingots into forged product forms such as rod, wire, spheres, etc. Such forged products may further be reduced in size and refined in shape by compressive grinding processes, without shattering, cracking, or spalling. Furthermore, shot and other firearm projectiles produced from these alloys may be softer than conventional gun barrel steel and will therefore minimize barrel scoring and wear.

In experiments, alloys containing tungsten (W) as the majority component were made to be ductile by including metallurgically appropriate amounts of nickel (Ni), iron (Fe), and/or manganese (Mn). Nickel and manganese are notable for, among other factors, their ability to stabilize the high-temperature "gamma" phase of ferrous alloys (a crystal form referred to as "austenite"). Accordingly, a range of alloys of nickel, iron, and tungsten, and optionally manganese and/or steel, were produced, are evaluated and/or proposed.

Illustrative examples of various medium-and high-density compositions according to the present disclosure, and methods for forming articles therefrom are presented below. In these examples, the percentages are weight percentages.

EXAMPLE 1

Vacuum arc-melted (TIG) buttons (100 g each) of three different alloys (Table 1) were prepared using the following input materials:

Pure W sheet (⅛" thick) or powder (−325 mesh) Caronyl Ni pellets (⅛"−¼" diameter) Electrolytic Mn (flakes) Pure Fe (−150 mesh powder)

TABLE 1

| | Compositions | | | |
|---|---|---|---|---|
| Alloy | Ni % | Mn % | Fe % | W % |
| 1 | 25 | 0 | 25 | 50 (powder) |
| 2 | 33.3 | 0 | 16.7 | 50 (powder) |
| 3 | 16.7 | 16.6 | 16.7 | 50 (sheet) |

During melting, it was observed that gas evolution occurred on the two buttons with W powder input, while the W sheet used for Alloy 3 did not totally dissolve. Nevertheless, the buttons proved to be ductile as indicated by filing, stamping, and bending by a hammer in a vise. A decision was made to repeat this experiment using a different form of tungsten as input.

EXAMPLE 2

The alloys of Table 1 (100 g each) were again prepared in the same way, but using −150 mesh ferrotungsten (80 wt % W −20 wt % Fe) instead of pure W. As used herein, all composition percentages should be understood to be expressed as weight percentages. Melting was much improved and complete dissolution of the ferrotungsten was achieved. During melting, it was observed that the Mn-bearing alloy was not as fluid as the other alloys. The alloy buttons were evaluated by performing Rockwell hardness tests on flat-ground areas of the buttons. Table 2 presents these results.

TABLE 2

| | Button Hardness |
|---|---|
| Alloy | Rockwell B hardness |
| 1 A | 86, 89, 90 (Ave: 88.3) |
| 2 A | 84, 85, 90, 89, 90 (Ave: 87.6) |
| 3 A | 91, 90 (Ave: 90.5) |

In a further variation, ferrotungsten containing 75 wt % tungsten and 25 wt % iron was used.

Densities were determined by weighing each button and by using water-displacement to estimate its volume. Table 3 presents measured densities for comparison against corresponding values calculated by the "rule-of-mixtures" method:

$$D,\ \mathrm{g/cm^3} = \frac{1\ \mathrm{g}}{\left(\frac{f,\mathrm{Ni}}{8.9} + \frac{f,\mathrm{Mn}}{7.43} + \frac{f,\mathrm{Fe}}{7.86} + \frac{f,\mathrm{W}}{19.3}\right)}$$

Where "f" indicates weight fraction of each element, which is then divided by its density in g/cc.

TABLE 3

Button Density

| Alloy | Measured, g/cc | Calculated, g/cc |
|---|---|---|
| 1 A | 11.3 | 11.7 |
| 2 A | 12.1 | 11.8 |
| 3 A | 11.8 | 11.3 |

Applying a permanent magnet to the buttons revealed that the ternary alloys (Alloys 1 A and 2 A) were ferromagnetic, whereas the quaternary alloy was non-magnetic. As in Example 1, ductility of the buttons was demonstrated by bending them at room temperature with a hammer and vise.

In these initial experiments, it was observed that (1) all three alloys were surprisingly similar in hardness (i.e., all were so soft as to be below the Rockwell C scale normally applicable to low-and high-alloy steels) and that (2) the 16 wt % Mn content was high enough to eliminate ferromagnetic properties of the alloy. (Both Fe and Ni are ferrogmagnetic, while W and Mn are not.) As mentioned previously, it is preferable that non-toxic shot be magnetic to allow game officers to easily check shotshells in the field and to allow magnetic collection and subsequent recycling/reloading of spent shot. The importance of including Mn in alloys of the present disclosure relates to making shot products more affordable to the general public.

In the following experiments, alloys containing Mn concentrations as high as 8.35 wt % were evaluated and found to be ferromagnetic.

EXAMPLE 3

The following alloys were produced from crushed (−¼ inch) ferrotungsten (76 wt % W), iron scrap (0.08 wt % max. C), carbonyl Ni pellets and electrolytic Mn.

TABLE 4

Designed Compositions

| Alloy | W % | Ni % | Fe % | Mn % |
|---|---|---|---|---|
| A | 50 | 33.3 | 16.7 | 0 |
| B | 50 | 30 | 20 | 0 |
| C | 50 | 30 | 16.7 | 3.3 |
| D | 50 | 30 | 11.65 | 8.35 |

Batches of approximately 85 lb were prepared for each alloy, melted in a 100-lb, 150-kw induction furnace, and cast at about 1500-1600° C. into "green sand" molds to produce eight bars of each alloy approximately 1.0-inch diameter by 24 inches long. The cast bars were trimmed, abrasively cleaned and machined. (Portions of the molten alloys were also taken for shot-drop casting and near-net-shape casting which are presented later in Examples 4 and 5.) Table 5 presents chemical compositions (based on actual analyses for tungsten), as-cast Rockwell B hardness, density and results of tests for ferromagnetism.

TABLE 5

Actual Compositions and Properties

| Alloy | W % | Ni % | Fe % | Mn % | $R_B$ | Magnetic | Density, g/cc |
|---|---|---|---|---|---|---|---|
| A | 48.3 | 33.3 | 18.4 | 0 | 83 | yes | 10.8 |
| B | 48.4 | 30.0 | 21.6 | 0 | 82 | yes | 11.3 |
| C | 48.3 | 30.0 | 18.4 | 3.3 | 83 | yes | 11.0 |
| D | 48.4 | 30.0 | 13.25 | 8.35 | 85 | yes | 10.9 |

Figure 11:
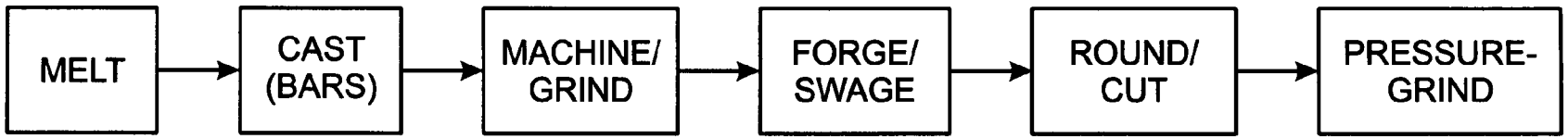
FIG. 11 shows illustrative processing steps that may be used to convert raw materials to firearm projectiles or other articles by forging a cast alloy bar.

One cast bar of each alloy was machined to approximately 0.8-in. diameter and swaged at room temperature in a conventional two-die impact swage. Using incremental diameter reductions of 0.010-0.020 in., all four alloys were successfully reduced by about 30-35% overall reduction-in-area (ROA) before ductility was lost. This degree of reduction was shown to be independent of whether "room-temperature" or "hot" (800° C.) swaging was employed. Although Alloy A actually achieved the largest ROA (35.4%) and Alloy D the smallest (29.4%), the inventor believes these small differences are insignificant. FIG. 11 is a schematic representation of a potential production process based upon the results of this experiment.

EXAMPLE 4

Figure 12:
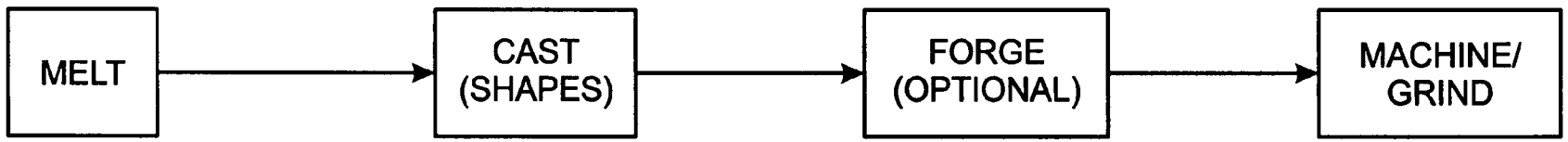
FIG. 12 shows illustrative processing steps that may be used to convert raw materials to finished near-net-shape castings.
Figure 13:
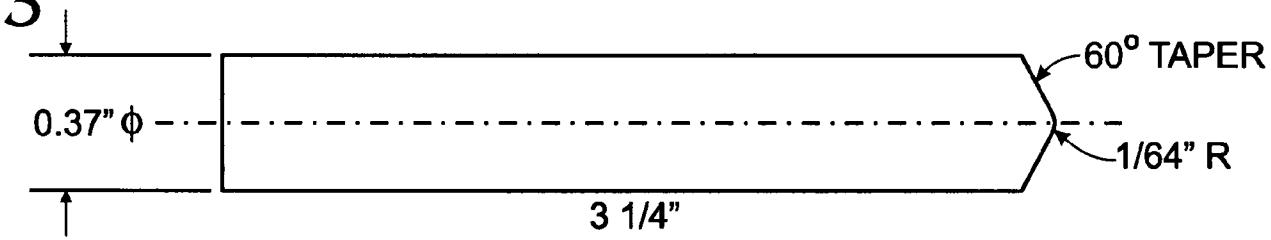
FIG. 13 shows an example of a near-net-shape casting made by the process of FIG. 12.

During the casting phase of Example 3, molten samples of all four alloys were directly cast into a variety of near-net shapes/sizes, including the following:

Alloys A, B, C and D were cast in 1"-dia.×1¼" L alumina molds and in 5/32"-dia.×6-12" L evacuated Pyrex tubes. Alloy B was additionally cast in a graphite mold to produce three bars 0.37"-dia.×3¼" L with conical ends (to simulate bullet shapes). These castings were subjectively evaluated for surface quality, porosity and density, and deemed to be of high quality. FIG. 12 presents an illustrative production process based upon these results, while FIG. 13 is a drawing of the actual near-net article produced in this example. The article shown in FIG. 13 may additionally and/or alternatively represent schematically other articles produced according to the present disclosure. Examples of these articles include shot, weights (such as golf club weights, fishing weights, wheel weights, diving belt weights, counterweights, ballast weights, and aircraft stabilizers), radiation shields, other firearms projectiles (such as bullets), and other articles conventionally made from lead. It should be understood that these illustrative articles may also be formed from the other methods and/or compositions described herein.

EXAMPLE 5

Yet another type of casting ("drop casting," such as used in shot towers for producing lead shot) was conducted during the melting phase of Example 3. Molten alloy samples were poured through ceramic sieves (with apertures of 0.050: dia.) suspended in air about 8.0 inches above the liquid level (18 in.) of a 20-gal. drum containing cold (30°

Figure 14:
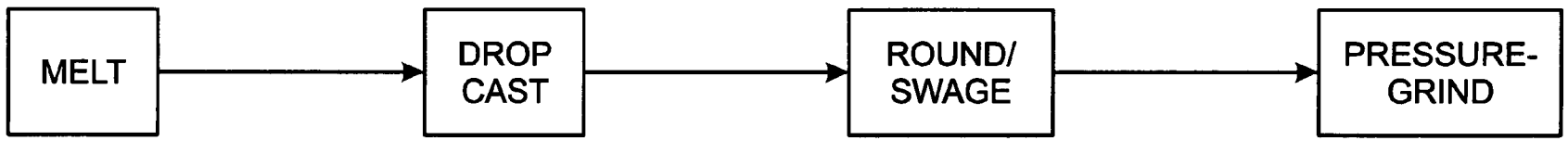
FIG. 14 shows illustrative processing steps that may be used to convert raw materials to shot by drop-casting, followed by swaging and pressure-grinding.

C.) water (in the cases of Alloys A, B and C) or 10% NaCl brine (in the case of Alloy D). The resulting solidified alloy droplets were found to be fully dense (11.3-12.0 g/cc), unfractured, and so ductile that they could be cold-reduced without cracking to less than half original thickness by impacting with a hammer. These simple experiments were conducted to illustrate the very different behavior of alloys of the present disclosure and that of binary Fe—W alloys which fracture when cooled rapidly (see U.S. Pat. No. 5,713,981) or when impact-deformed. FIG. 14 presents a potential production process based upon these results. In the drop casting step, it is within the scope of the disclosure that the molten alloy may be passed through one or more sieves, or sieve trays, which separate the molten liquid into droplets, or alternatively, that the articles (such as shot) may be formed through drop casting without passing the molten alloy through a sieve. Regardless of whether or not the streams or droplets are passed through sieves or other separation or dispersing structure, they are quenched, such as by passing into and/or through a quenching medium, or quenchant, such as water.

EXAMPLE 6

To demonstrate that alloys of the present disclosure may be effectively salvaged, recycled and remelted, 43.4 lb of cast Alloy C bars and 24.4 lb of Alloy A cast scrap were remelted by induction and recast into the following shapes:

2 pcs: 2¾" dia.×6", graphite molds 6 pcs: 5/32" dia.×6-12" L, in evacuated Pyrex tubes 1 mold: 3 bars ⅜" dia.×4" L, in graphite mold 1 mold: 4 wires ⅛" dia.×3" L, in graphite mold Surface quality, density, ductility, ferro-magnetism, etc. were found to be equivalent to those of virgin metal (Alloys A-D). The approximate composition of this alloy ("AC hybrid") was:

48.3 wt % W 31.2 wt % Ni 18.4 wt % Fe 2.1 wt % Mn

EXAMPLE 7

Alloys are formed from melting and casting tungsten, nickel and iron, and optionally manganese, with tungsten forming no more than 50 wt % of the materials forming the alloy. Exemplary compositions are listed in the following table. In a variation of the following compositions, steel is substituted for manganese. The alloys may be used to form all or substantially all of shot and/or other articles.

TABLE 6

| | Designed Compositions | | | |
|---|---|---|---|---|
| Alloy | W % | Ni % | Fe % | Mn % |
| A | 50 | 35 | 15 | 0 |
| B | 25 | 10 | 55 | 10 |
| C | 35 | 10 | 35 | 20 |
| D | 30 | 15 | 55 | 0 |
| E | 30 | 15 | 45 | 10 |
| F | 30 | 15 | 35 | 20 |

EXAMPLE 8

Shot and articles may be formed or at least substantially formed from alloys formed by melting and casting materials having the following compositions.

TABLE 7

| | Designed Compositions | | | |
|---|---|---|---|---|
| Alloy | W % | Ni % | Fe % | Hardness |
| A | 54 | 32.2 | 13.8 | 89.3 Rb |
| B | 54 | 29.2 | 16.8 | 95.9 Rb |
| C | 54 | 24.2 | 21.8 | 95.6 Rb |
| D | 54 | 14.2 | 31.8 | 95.6 Rb |
| E | 54 | 9.2 | 36.8 | 35 Rc |
| F | 54 | 4.2 | 41.8 | 52.4 Rc |

Figure 3:
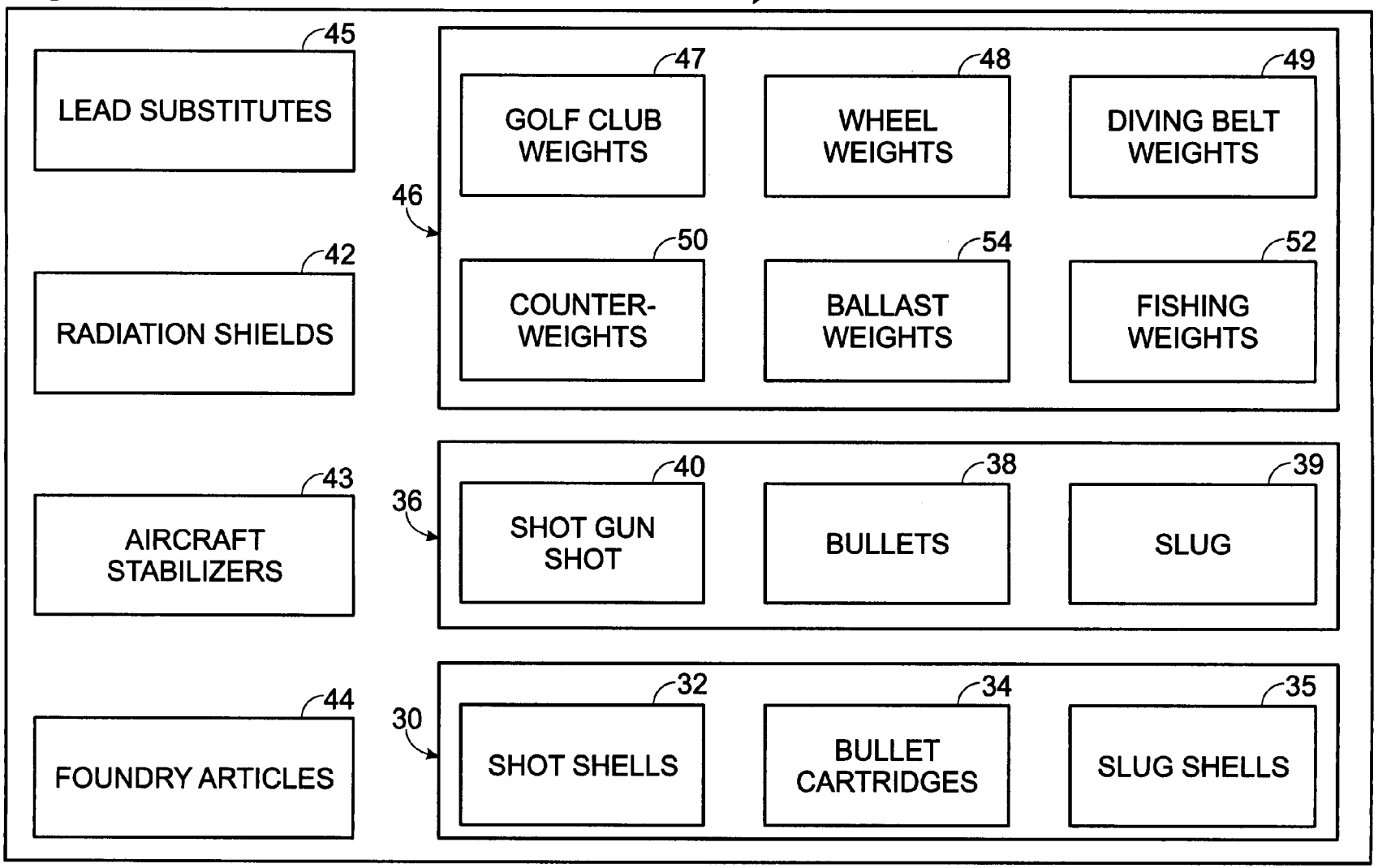
FIG. 3 is a diagram illustrating examples of articles that have conventionally been formed from lead and which may be constructed with density-enhanced materials according to the present disclosure.

Articles 10 produced with the compositions 12 and/or methods discussed herein may take a variety of forms, including being used to form articles that conventionally have been produced from lead. However, unlike lead, article 10 is preferably formed from non-toxic, environmentally safe components. Illustrative examples of forms for article 10 include a firearm projectile 36, such as a bullet 38, slug 39, or shot 40, a radiation shield 42, aircraft stabilizer 43, foundry article 44, lead substitute 45, or weights 46, such as a golf club weight 47, wheel weight 48, diving belt weight 49, counterweight 50, fishing weight 52, ballast weight 54, etc. Examples of these articles are schematically depicted in FIG. 1. One or more firearm projectiles 36 may be used in articles in the form of firearm cartridges 30, such as shot cartridges, or shells, 32, bullet cartridges 34, and slug cartridges, or shells, 35, as also schematically depicted in FIG. 3.

Firearm projectiles 36 may be entirely formed from composition 12. Illustrative types of firearm projectiles include bullets and shot. Firearm shot may also be referred to as shot pellets. However, it is within the scope of the present disclosure that the projectiles may include additional components or structures, such as protective outer coatings, binders, lubricants, etc. However, excluding any form of surface coating or jacket, projectiles 36 according to the present disclosure will be at least substantially (at least 80 wt %), if not nearly completely (at least 90 wt %), or completely formed from composition 12. The bullets and shot may be incorporated into firearm cartridges, as discussed in more detail herein. The projectiles and cartridges disclosed herein may be produced via any suitable process for manufacturing the same. Various illustrative (non-exclusive) examples of exemplary formation processes using powder metallurgy and molten feedstocks will be discussed below. Other articles 10 will typically include at least a core or body that is at least substantially formed from composition 12, but also may include other structural and/or functional components.

In FIG. 4 a schematic representation of an article 10, namely firearm projectile 36, in the form of a shot, or shot pellet, 40 that is formed from density-enhanced composition 12 is shown. As shown, pellet 40 has a spherical configuration. However, it is within the scope of the present disclosure that pellet 40 may have a variety of regular and irregular configurations, with pellet 40 schematically representing this range of sizes. As illustrative (non-exclusive) examples, pellets 40 that are formed by casting a molten mass of composition 12 or via powder metallurgy will tend to have more regular configurations, while pellets 40 that are formed by pouring or otherwise dropping a molten mass of composition 12 into a quenching liquid will tend to have more irregular shapes.

As shown in FIG. 5, shot, or shot pellet, 40 may be a constituent element of a firearm cartridge 30 in the form of a shotgun cartridge, or shot shell, 32. As shown, cartridge 32 is ready to be loaded into a firearm, such as a shotgun, and upon firing, discharge shot pellets 40 at high speeds. Shot cartridge 32 may be configured for compatibility with a variety of firearms. In particular, the cartridge may be sized for proper loading into different caliber firearms. Examples of conventional shotgun sizes, with reference to the diameter of the barrel of the shotgun, include 8, 10, 12, 16, 20, and 28 gauge shotguns, as well as a .410 shotgun, which refers to a barrel with a diameter of 0.41 inches. A plurality of shot pellets 40 are loaded into a shotgun shell, or shotgun cartridge, with the number of individual pellets contained in the cartridge varying from approximately 5-10 pellets to dozens or hundreds of pellets, such as depending upon the dimensions of the pellets and/or the intended application for the cartridge.

As shown in FIG. 5, cartridge 32 includes a case, or casing, 80. Casing 80 includes a base 88, which is typically formed from metal and houses the cartridge's wad 82, charge 84 and primer, or priming mixture, 86. The casing also includes a hull, or shot-region, 90 that is typically formed from plastic or another suitable non-metallic component and which defines a chamber 92 in which a plurality of shot pellets 40 are housed. The chamber may include a shot receptacle, or shot cup, within the chamber and into which the shot pellets are received. The shot receptacle may be integrated with the wad, or may be a separate structure. The top of the hull is typically crimped closed, although other constructions and sealing methods may be used. As discussed, a conventional shotgun cartridge is designed to house a plurality of shot pellets, which in a shotgun cartridge constructed according to the present disclosure will include a plurality of pellets 40. It is within the scope of the disclosure that cartridge 32 may include other constituent elements, as are conventional or otherwise known in the field of shotgun cartridge construction.

The shot within cartridge 32 includes a plurality of individual shot pellets 40, which may be individually sized and shaped. Typically, each of the shot pellets 40 will have at least substantially the same size and shape as the other pellets used in the same round. However, it is also within the scope of the disclosure that cartridge 32 may include shot pellets 40 having two or more distinct sizes, or ranges of sizes, and/or two or more densities, or ranges of density. The precise size of the shot pellets may be selected according to the desired use of the shot. For example, if designed for use as buckshot, each pellet 40 will typically have a diameter D of approximately 0.24 to 0.36 inches. When designed for use as birdshot, each pellet 40 will typically have a diameter of approximately 0.08-0.2 inches. For purposes of providing further examples, the following table provides examples of conventional shot sizes and the corresponding pellet diameters.

| Buckshot | | Birdshot | |
|---|---|---|---|
| size | diameter (inches) | size | diameter (inches) |
| No. 4 | 0.24 | No. 9 | 0.08 |
| No. 3 | 0.25 | No. 8 | 0.09 |

-continued

| Buckshot | | Birdshot | |
|---|---|---|---|
| size | diameter (inches) | size | diameter (inches) |
| No. 1 | 0.30 | No. 7.5 | 0.095 |
| No. 0 | 0.32 | No. 7 | 0.1 |
| No. 00 | 0.33 | No. 6 | 0.11 |
| No. 000 | 0.36 | No. 5 | 0.12 |
| | | No. 4 | 0.13 |
| | | No. 3 | 0.14 |
| | | No. 2 | 0.15 |
| | | No. 1 | 0.16 |
| | | No. B | 0.17 |
| | | No. BB | 0.18 |
| | | No. BBB | 0.19 |
| | | No. T | 0.20 |

The number of individual shot pellets 40 in a particular shotgun cartridge 32 will tend to vary at least partially upon the diameter of the individual shot pellets. For example, a 12-guage, 2.75" long double ought buckshot cartridge will typically include nine shot pellets, while most birdshot cartridges will include dozens, if not hundreds, of shot pellets.

Figure 6:
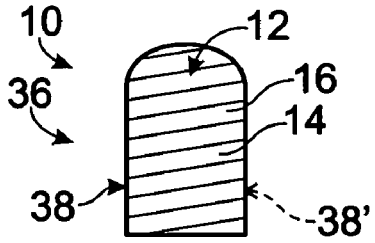
FIG. 6 is a schematic depiction of a firearm projectile in the form of a bullet formed from a density-enhanced material according to the present disclosure.

In FIG. 6, an example of a firearm projectile 36 in the form of a bullet that is at least substantially, if not completely, formed from composition 12 is shown and generally indicated at 38. It is within the scope of the present disclosure that bullet 38 may take any suitable shape and configuration, such as those known in the art for conventional bullets. As also indicated in dashed lines at 38' in FIG. 6, the illustrated projectile may also form a core for a jacketed bullet. As such, core 38' may be described as being another example of a firearm projectile that is formed at least substantially from composition 12.

Figure 7:
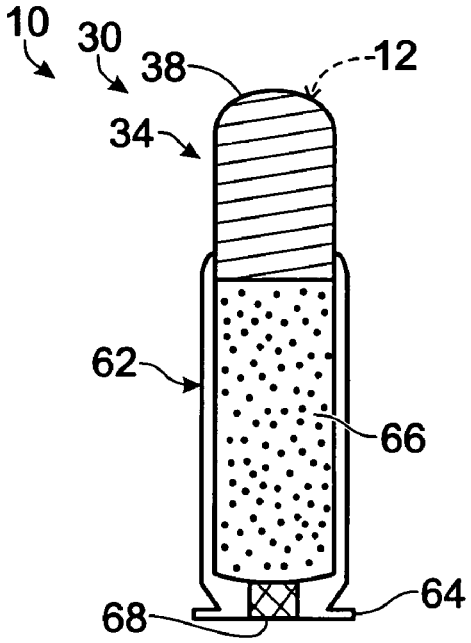
FIG. 7 is a schematic cross-sectional depiction of a firearm cartridge containing a bullet according to the present disclosure.

In FIG. 7, a firearm cartridge 30 is shown that contains a bullet 38 according to the present disclosure. Accordingly, such a cartridge may be referred to as a bullet cartridge 34. Cartridge 34 includes bullet 38 and a case or casing 62. Casing 62 includes a cup 64, a charge 66 and a primer, or priming mixture, 68. Casing, primer and charge may be of any suitable materials, as is known in the art of firearms. Cartridge 34 is ready to be loaded into a gun, such as a handgun, rifle or the like, and upon firing, discharges bullet 38 at high speeds and with a high rate of rotation. Although illustrated in FIG. 7 as a centerfire cartridge, in which primer 68 is located in the center of the base of casing 62, bullets according to the present disclosure may also be incorporated into other types of cartridges, such as a rimfire cartridge, in which the casing is rimmed or flanged and the primer is located inside the rim of the casing.

Figure 8:
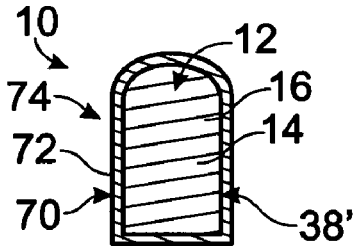
FIG. 8 is a schematic depiction of a jacketed bullet formed from the density-enhanced material according to the present disclosure.
Figure 9:
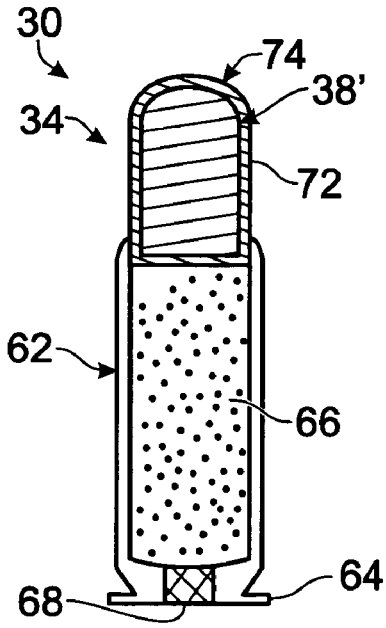
FIG. 9 is a schematic cross-sectional depiction of a firearm cartridge containing a jacketed bullet according to the present disclosure.

It is within the scope of the present disclosure that bullet 38 may include a protective coating 70, such as a jacket 72, as shown in FIG. 8. In such an embodiment, bullet 38 may be referred to as a jacketed bullet, as indicated in FIG. 8 at 74, and jacket 72 may be described as at least substantially, if not completely, enclosing a core 38' formed at least substantially from composition 12. In FIG. 9, the jacketed bullet is shown forming a component of a firearm cartridge 30 in the form of a bullet cartridge 34. Because bullets are commonly expelled from firearms at rotational speeds greater than 10,000 rpm, the bullets encounter significant forces. When the bullet is formed from powders, there is a tendency for these rotational forces to remove portions of the bullet during firing and flight. Jacket 72 may be used to prevent these centrifugal forces from fragmenting, obturing (deforming on account of fragmenting and centrifugal forces), and/or dispersing the core during flight.

Jacket 72 may partially or completely enclose the bullet core. For example, it is within the scope of the disclosure that jacket 72 may completely enclose the bullet core. Alternatively, the jacket may only partially enclose the core, thereby leaving a portion of the core not covered by the jacket. For example, the tip of the bullet may be unjacketed. Jacket 72 may have a variety of thicknesses. Typically, jacket 72 will have an average thickness of approximately 0.025 inches or less, including an average thickness of approximately 0.01 inches or less. Accordingly, it should be understood that the depicted thickness of the jacket and relative thickness of the jacket compared to the overall shape and size of the bullet in FIGS. 7 and 8 have been exaggerated for the purpose of illustration.

An example of a suitable material for jacket 72 is copper, although other materials may be used. For example, jacket 72 may be additionally or alternatively formed from one or more other metallic materials, such as alloys of copper like brass, a ferrous metal alloy, or aluminum. As another example, jacket 72 may be formed from an alloy of copper and zinc (such as approximately 5% zinc) when the projectiles are designed to be higher velocity projectiles, such as projectiles that are designed to travel at speeds of at least 2,000, 2,500 or more feet per second. Jacket 72 may also be formed from a non-metal material, such as a polymer or a plastic. An example of such a material is nylon. When jacket 72 is formed from metallic materials, the bullet may be formed by compressing the powder and the binder in the jacket. Alternatively, the bullet core may be formed and thereafter placed within a jacket. As another example, the bullet core may be formed and then the jacket may be applied over the core by electroplating, vapor deposition, spray coating or other suitable application methods. For non-metallic jackets, dip coating, spray coating and similar application methods have proved effective.

Some firearms, such as handguns and rifles, have barrels with rifling that projects internally into the barrels to impart axial rotation to the bullet. Accordingly, a jacketed bullet according to the present invention preferably has a jacket thickness that exceeds the height of the rifling. Otherwise, it may be possible for the rifling to cut through the jacket and thereby expose the bullet core. This, in turn, may affect the flight and performance of the bullet, as well as increase fouling of the barrel. A jacket thickness that is at least 0.001 inches, and preferably at least 0.002 to 0.004 inches, thicker than the height of the rifling lands has proven effective. For most applications, a jacket 72 that is at least 0.005 inches thick should be sufficient. In firearms, such as shotguns, that have barrels with smooth (non-rifled) internal bores, a thinner jacket may be used, such as a jacket that is 0.001-0.002 inches thick. However, it should be understood that it is not required in these applications for the jacket to be thinner and that thicker jackets may be used as well.

In FIG. 10, a golf club constructed with golf club weight 47 that is at least substantially, if not completely, formed from composition 12 is shown and generally indicated at 100. Club 100 includes an elongate shaft 102, which typically includes a grip 104, and a head 106 with a face 108 adapted to strike a golf ball. The shape and configuration of club 100 may vary, such as from a putter, to an iron, to a driver or other wood.

As indicated above, one method for forming articles, such as projectiles 36, from density-enhanced composition 12 is to form the articles from a molten feedstock that is at least substantially, if not entirely, comprised of composition 12. For example, composition 12 may be melted by heating to or above the above-discussed liquidus temperatures. Typically, it may be desirable to heat the composition to at least 10-25° C. above the liquidus temperature to prevent unintentional crystallization or other solidification of portions of the composition prior to the intentional solidification of the composition.

The projectiles (or other articles) may be formed from the molten composition by any suitable process, including casting into dies or other molds and casting into a quenchant or quenching medium. When dies or other molds are used, the solidified composition (such as after cooling in the die or mold) will have a shape that is defined by the shape of the mold. Casting with a quenchant or quenching medium refers to pouring the molten composition into at least one quenching medium to solidify the molten composition. The quenching medium may include gaseous, liquid, and/or solid quenching media, or "quenchants." For example, quenching may be achieved by pouring the molten composition through a vacuum, through air or through another gas prior to entering a liquid or solid quenching medium. Illustrative examples of suitable liquid quenchants include water, aqueous salt or other solutions, molten salts, molten metals (which have a melting point that is lower than the temperature at which composition 12 solidifies). The molten composition may be poured through a sieve, which will include a plurality of a predetermined size or of predetermined sizes. However, it is also within the scope of the disclosure that the molten composition may be poured or otherwise released through air (or another gaseous environment) and then into the quenching liquid without using a sieve. Casting with dies or other molds is conventionally used for bullets, slugs, larger sizes of shot, and most other articles in which the articles desirably have a larger or selected shape. Casting with quenching is conventionally used for smaller and medium-sized shot and for other articles in which the particular shape is not critical. For example, some weights may be formed from one or more particles of composition 12, such as which have a particular density, without requiring a specific or regular shape for the particles.

After forming a solidified mass from the molten mass of composition 12, the solidified mass may be a finished article, including a finished projectile that is ready to be loaded into a firearm cartridge. However, it is also within the scope of the disclosure that the projectile or other article may be referred to as an intermediate structure, in that one or more additional steps will be taken prior to forming the finished article. In the context of firearms, this step may include forming a firearm cartridge that includes one or more projectiles produced according to the present disclosure. For example, it is within the scope of the disclosure that the intermediate structure may be worked, such as to be ground or otherwise reshaped. As another example, the intermediate structure may have a protective coating applied to its outer surface. Illustrative coatings include sealants and jackets. Although discussed in the context of different tungsten-containing compositions, illustrative examples of methods for forming firearm projectiles from a molten mass of a tungsten-containing composition are disclosed in at least several of the above-incorporated U.S. Patents, as well as in U.S. patent applications Ser. Nos. 10/688,071 and 10/698,827, the complete disclosures of which are hereby incorporated by reference for all purposes.

Another illustrative method for forming firearm projectiles or other articles from density-enhanced composition 12 is via powder metallurgy. As an initial step in such a method, a composition 12 is obtained in powder form. As used herein, the term "powder" is meant to include particulate having a variety of shapes and sizes, which may include generally spherical or irregular shapes, flakes, needle-like particles, chips, fibers, equiaxed particles, etc. The components of the composition may be obtained in powder form and mixed together. As another example, one or more of the components may be obtained in non-powder form and thereafter ground to powder form prior to, during, or after mixing with one or more other components of composition 12. When powder metallurgy is utilized, the composition will typically include a binder and may include a small amount of a lubricant. Illustrative examples of suitable binders include one or more of a non-metallic binder (such as at least one thermoplastic and/or thermoset resin) and a metallic binder, such as tin, tin alloys or other comparatively soft metals. The binder may also be in powder form, but it is also within the scope of the disclosure to use binders that are not in powder form.

The solid components are then mixed together. This mixing may include blending the components together and/or milling the components. When milling is used, any suitable milling process, including high-energy milling, may be utilized. The mixed components are placed into a die, and then compacted to form an article 10 (such as a weight, bullet, bullet core, slug, or shot pellet), or an intermediate structure from which an article is formed. When an intermediate structure is formed, i.e. when the compacted structure undergoes further processing before it is ready to be used to form a finished article, the intermediate structure may be selectively subjected to one or more post-compaction processes. Illustrative examples include reshaping, grinding, sintering (liquid and/or solid phase), heating, binder actuation, plating, jacketing, sealing, and the like. Although discussed in the context of different tungsten-containing compositions, illustrative examples of various powder metallurgy processes and post-compaction processes are disclosed in U.S. Pat. Nos. 6,447,715 and 6,248,150, as well as in U.S. Published Patent Application Serial No. 20020124759A1, U.S. patent applications Ser. Nos. 10/011,148 and 10/061,759, and U.S. Provisional Patent Applications Ser. Nos. 60/423,232, 60/423,331, and 60/422,937, the complete disclosures of which are hereby incorporated by reference for all purposes.

Articles 10 formed from density-enhanced composition 12 may be prone to rusting, especially when the composition contains only trace, or no, nickel. As it is within the scope of the disclosure that composition 12 may contain varying amounts of nickel, including no nickel at all, in some applications it may be desirable to provide a rust-inhibiting coating to the article. This is schematically depicted in dashed lines in FIG. 1 at 110 to indicate that this step is not required.

One suitable method for making articles 10 resistant to rust is to plate the articles with a metal coating. Illustrative (non-exclusive) examples of suitable metal coatings include copper, zinc and alloys thereof. Such a coating may be applied via any suitable technique. Another method is to apply a rust-inhibiting liquid, such as an oil, and/or to apply a curable, or settable, material to the projectiles or other articles. Still another method is to dip the articles in a rust-inhibiting salt solution and thereafter dry the projectiles. An example of a suitable salt solution is sodium nitrite, although it is within the scope of the disclosure that others may be used. It is also within the scope of the disclosure that the articles may be dipped in the salt (or other rust-inhibiting) solution at a variety of points in the formation process. For example, the articles may be dipped in the solution after formation of the near (or final) net shape article. Therefore, the articles may be dipped in the solution prior to being worked (if any working is to be performed) or after being worked to a final shape. When the articles are formed from a molten composition 12 and thereafter quenched, the salt (or other rust-inhibiting) solution may be used as the quench medium. Additionally or alternatively, the quenched articles may be dipped in the salt (or other rust-inhibiting) solution after quenching. Also, for some articles, such as which will be encased in a housing or other container in which rusting is either not likely to occur or in which some rusting of the articles will not affect use of the articles, this rest-inhibiting step may not be needed. Similarly, composition 12 may not be prone to rusting, such as to do the selection and relative percentage of the components contained therein.

INDUSTRIAL APPLICABILITY

The present disclosure provides a range of alloy compositions and methods of manufacturing medium- and high-density articles, including shot and other firearm projectiles, and substitutes for other articles that have conventionally been formed from lead or a lead alloy.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Where the disclosure or subsequently filed claims recite "a" or "a first" element or the equivalent thereof, it should be within the scope of the present inventions that such disclosure or claims may be understood to include incorporation of one or more such elements, neither requiring nor excluding two or more such elements.

Applicant reserves the right to submit claims directed to certain combinations and subcombinations that are directed to one of the disclosed inventions and are believed to be novel and non-obvious. Inventions embodied in other combinations and subcombinations of features, functions, elements and/or properties may be claimed through amendment of those claims or presentation of new claims in that or a related application. Such amended or new claims, whether they are directed to a different invention or directed to the same invention, whether different, broader, narrower or equal in scope to the original claims, are also regarded as included within the subject matter of the inventions of the present disclosure.

I claim:

1. A shotgun shell, comprising:

a casing containing at least wadding, a charge and a primer;

a plurality of shell shot within the casing, wherein the shell shot are at least substantially formed from a cast alloy comprising:

20-35 wt % tungsten;

5-20 wt % nickel; and 50-75 wt % iron.

2. The shell of claim 1, wherein the cast alloy further comprises steel.

3. The shell of claim 1, wherein the cast alloy further comprises manganese.

4. The shell of claim 1, wherein the cast alloy contains ferrotungsten.

5. The shell of claim 1, wherein the cast alloy has a density in the range of 8-10.5 g/cc.

6. The shell of claim 1, wherein the cast alloy has a density in the range of 10.5-15 g/cc.

7. The shell of claim 1, wherein the alloy includes 10-20 wt % nickel.

8. The shell of claim 1, wherein the alloy has a hardness of less than 275 Brinell.

9. The shell of claim 1, wherein the alloy has a hardness of less than 270 Brinell.

10. The shell of claim 1, wherein the alloy includes 20-30 wt % tungsten.

11. A shotgun shell, comprising:

casing containing at least wadding, a charge and a primer;

a plurality of shell shot within the casing, wherein the shell shot are at least substantially formed from a cast alloy comprising:

5-29.3 wt % tungsten;

5-20 wt % nickel; and 50-75 wt % iron.

12. The shell of claim 11, wherein the cast alloy further comprises steel.

13. The shell of claim 11, wherein the cast alloy further comprises manganese.

14. The shell of claim 11, wherein the cast alloy contains ferrotungsten.

15. The shell of claim 11, wherein the cast alloy has a density in the range of 8-10.5 g/cc.

16. The shell of claim 11, wherein the cast alloy has a density in the range of 10.5-15 g/cc.

17. The shell of claim 11, wherein the alloy includes 10-20 wt % nickel.

18. The shell of claim 11, wherein the alloy has a hardness of less than 275 Brinell.

19. The shell of claim 11, wherein the alloy has a hardness of less than 270 Brinell.

20. The shell of claim 11, wherein the alloy includes 20-29.3 wt % tungsten.

* * * * *